US012269629B2

(12) United States Patent
Duperray et al.

(10) Patent No.: US 12,269,629 B2
(45) Date of Patent: Apr. 8, 2025

(54) PACKAGING APPARATUS FOR SECONDARY PACKAGES

(71) Applicant: Anheuser-Busch InBev S.A., Brussels (BE)

(72) Inventors: Philippe Jean Marie Duperray, Châteauroux (FR); Wim DeKocker, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 231 days.

(21) Appl. No.: 17/631,293

(22) PCT Filed: Jul. 29, 2020

(86) PCT No.: PCT/EP2020/071379
§ 371 (c)(1),
(2) Date: Jan. 28, 2022

(87) PCT Pub. No.: WO2021/018952
PCT Pub. Date: Feb. 4, 2021

(65) Prior Publication Data

US 2022/0258888 A1 Aug. 18, 2022

(30) Foreign Application Priority Data

Jul. 30, 2019 (EP) ..... 19189079
Dec. 26, 2019 (EP) ..... 19219726

(51) Int. Cl.
*B65B 11/08* (2006.01)
*B65B 5/02* (2006.01)
(Continued)

(52) U.S. Cl.
CPC ..... *B65B 11/004* (2013.01); *B65B 5/024* (2013.01); *B65B 11/08* (2013.01); *B65B 21/24* (2013.01);
(Continued)

(58) Field of Classification Search
USPC ..... 53/456
See application file for complete search history.

(56) References Cited

U.S. PATENT DOCUMENTS 2,358,292 A 9/1944 Malhiot
3,555,776 A 1/1971 Nigrelli et al.
(Continued)

FOREIGN PATENT DOCUMENTS

BE 1027586 B1 4/2021
BR PI0923133 B1 6/2019
(Continued)

OTHER PUBLICATIONS

ABB Robotics, "Picking and packing salami snacks," <https://www.youtube.com/watch?v=aPTd8XDZOEk> YouTube publication date Apr. 19, 2010.
(Continued)

*Primary Examiner* — Chinyere J Rushing-Tucker
(74) *Attorney, Agent, or Firm* — ArentFox Schiff LLP

(57) ABSTRACT

The present invention provides a packaging apparatus for in-line packaging wrapping of a foldable blank around a receiving load that is simultaneously dropped onto the loading space of the foldable blank. The packaging apparatus includes a support means adapted to receive a supply of one or more foldable blanks. The support means includes a support frame supported onto two or more parallel longitudinal rails positioned generally transversal to a direction of supply of foldable blanks. The apparatus further includes an article loading mechanism to load a group of articles onto a loading space defined onto the foldable blank received onto the support means. The apparatus furthermore includes an erecting mechanism having a plurality of generally spaced apart vertical lugs, positioned onto one or more sides of the support frame, and at a height lower than the height of longitudinal rails such that a vertically upward movement of
(Continued)

the lugs engages and erects at least one side of the foldable blank around the articles already loaded onto the foldable blank.

10 Claims, 13 Drawing Sheets

(51) Int. Cl.

| | |
|---|---|
| ***B65B 11/00*** | (2006.01) |
| ***B65B 21/24*** | (2006.01) |
| ***B65B 35/30*** | (2006.01) |
| ***B65B 43/10*** | (2006.01) |
| ***B65B 43/12*** | (2006.01) |
| ***B65B 43/14*** | (2006.01) |
| ***B65B 49/08*** | (2006.01) |
| ***B65B 59/00*** | (2006.01) |

(52) U.S. Cl.
CPC ..... *B65B 35/30* (2013.01); *B65B 43/10* (2013.01); *B65B 43/126* (2013.01); *B65B 43/145* (2013.01); *B65B 49/08* (2013.01); *B65B 59/001* (2019.05); *B65B 2210/04* (2013.01)

(56) References Cited

U.S. PATENT DOCUMENTS

| | | | |
|---|---|---|---|
| 3,601,246 | A | 8/1971 | Dubois |
| 3,815,320 | A | 6/1974 | Ganz |
| 3,841,476 | A | 10/1974 | Elford |
| 4,191,003 | A | 3/1980 | Talarico |
| 4,641,742 | A | 2/1987 | Igarashi et al. |
| 5,011,126 | A | 4/1991 | Suzuki et al. |
| 5,237,468 | A | 8/1993 | Ellis |
| 5,261,520 | A | 11/1993 | Duke |
| 5,388,389 | A | 2/1995 | Tisma |
| 5,558,200 | A | 9/1996 | Whitby et al. |
| 5,607,045 | A | 3/1997 | Hermann Kronseder |
| 6,191,507 | B1 | 2/2001 | Peltier et al. |
| 6,201,203 | B1 | 3/2001 | Tilles |
| 6,209,710 | B1 | 4/2001 | Mueller et al. |
| 6,421,984 | B1 | 7/2002 | Murgatroyd et al. |
| 6,467,608 | B2 | 10/2002 | Stauber |
| 6,733,224 | B1 | 5/2004 | Linner |
| 6,811,019 | B2 | 11/2004 | Christian et al. |
| 6,848,566 | B2 | 2/2005 | Harnish et al. |
| 6,868,652 | B2 | 3/2005 | Arends et al. |
| 6,876,107 | B2 | 4/2005 | Jacobs |
| 6,904,733 | B2 | 6/2005 | Boix Jaen |
| 7,093,408 | B2 | 8/2006 | Duperray et al. |
| 7,134,258 | B2 | 11/2006 | Kalany et al. |
| 7,146,784 | B1 | 12/2006 | Portrait |
| 7,153,085 | B2 | 12/2006 | Clark et al. |
| 7,309,203 | B2 | 12/2007 | Clark et al. |
| 7,310,925 | B2 | 12/2007 | Monti |
| 7,320,203 | B2 | 1/2008 | Monti |
| 7,392,630 | B2 | 7/2008 | Ford |
| 7,401,451 | B2 | 7/2008 | Bennett |
| 7,401,453 | B2 | 7/2008 | Ford |
| 7,461,838 | B2 | 12/2008 | Hendricks et al. |
| 7,543,424 | B2 | 6/2009 | Lechner et al. |
| 7,543,425 | B2 | 6/2009 | Monti |
| 7,549,276 | B2 | 6/2009 | Monti |
| 7,552,570 | B2 | 6/2009 | Raudat et al. |
| 7,631,474 | B2 | 12/2009 | Ford |
| 7,735,296 | B2 | 6/2010 | Momich |
| 7,779,606 | B2 | 8/2010 | Ford |
| 7,789,219 | B2 | 9/2010 | Baldanza et al. |
| 7,803,099 | B2 | 9/2010 | Biraud et al. |
| 7,806,250 | B2 | 10/2010 | Ford |
| 8,033,082 | B2 | 10/2011 | Raudat et al. |
| 8,096,409 | B2 | 1/2012 | Wipf et al. |
| 8,322,514 | B2 | 12/2012 | Bonnain et al. |
| 8,430,232 | B2 | 4/2013 | Baldanza et al. |
| 8,448,777 | B2 | 5/2013 | Pazdernik |
| 8,534,727 | B2 | 9/2013 | Weclawski et al. |
| 8,671,651 | B2 | 3/2014 | Poutot |
| 8,776,985 | B2 | 7/2014 | Huettner et al. |
| 8,777,552 | B2 | 7/2014 | Ward et al. |
| 8,876,182 | B2 | 11/2014 | Eidelberg et al. |
| 8,903,540 | B2 | 12/2014 | Stork et al. |
| 9,045,291 | B2 | 6/2015 | Konrad et al. |
| 9,061,838 | B2 | 6/2015 | Van De et al. |
| 9,199,757 | B2 | 12/2015 | Kolb |
| 9,233,800 | B2 | 1/2016 | Senn et al. |
| 9,309,016 | B2 | 4/2016 | Stork et al. |
| 9,365,366 | B2 | 6/2016 | Girtman |
| 9,403,611 | B2 | 8/2016 | Sacchetti et al. |
| 9,533,785 | B2 | 1/2017 | Rapp et al. |
| 9,540,127 | B2 | 1/2017 | Papsdorf et al. |
| 9,546,049 | B2 | 1/2017 | Lindauer |
| 9,573,771 | B2 | 2/2017 | Papsdorf et al. |
| 9,580,253 | B2 | 2/2017 | Papsdorf et al. |
| 9,604,792 | B2 | 3/2017 | Wipf |
| 9,611,102 | B2 | 4/2017 | Job et al. |
| 9,725,197 | B2 | 8/2017 | Pettersson et al. |
| 9,731,854 | B2 | 8/2017 | Mann et al. |
| 9,796,495 | B2 | 10/2017 | Boden et al. |
| 9,802,507 | B2 | 10/2017 | Clark |
| 9,809,392 | B2 | 11/2017 | Walter et al. |
| 9,856,092 | B2 | 1/2018 | Job et al. |
| 9,873,571 | B2 | 1/2018 | Hahn |
| 9,938,031 | B2 | 4/2018 | Shurtleff et al. |
| 9,950,875 | B2 | 4/2018 | Walter et al. |
| 9,957,072 | B2 | 5/2018 | Shurtleff et al. |
| 9,963,258 | B2 | 5/2018 | Rapp et al. |
| 9,988,166 | B2 | 6/2018 | Avril et al. |
| 10,029,855 | B2 | 7/2018 | Grosskreuz et al. |
| 10,106,331 | B2 | 10/2018 | Radak et al. |
| 10,139,351 | B2 | 11/2018 | Piana et al. |
| 10,150,219 | B2 | 12/2018 | Ridel et al. |
| 10,161,970 | B2 | 12/2018 | Sun et al. |
| 10,246,266 | B2 | 4/2019 | Weber et al. |
| 10,287,105 | B2 | 5/2019 | Hayashi et al. |
| 10,407,195 | B2 | 9/2019 | Sassi et al. |
| 10,486,914 | B2 | 11/2019 | Choplin |
| 10,604,291 | B2 | 3/2020 | Hutter et al. |
| 10,669,049 | B2 | 6/2020 | Eberhardt et al. |
| 10,696,488 | B2 | 6/2020 | Papsdorf et al. |
| 10,717,606 | B2 | 7/2020 | Papsdorf et al. |
| 10,766,650 | B2 | 9/2020 | Choplin et al. |
| 10,773,847 | B2 | 9/2020 | Bellante |
| 10,829,255 | B2 | 11/2020 | Aumann et al. |
| 10,850,881 | B2 | 12/2020 | Langen et al. |
| 10,882,704 | B2 | 1/2021 | Torrero |
| 10,919,705 | B2 | 2/2021 | Papsdorf et al. |
| 11,001,400 | B2 | 5/2021 | Kalany et al. |
| 2001/0019006 | A1 | 9/2001 | Stauber |
| 2003/0015402 | A1 | 1/2003 | Bennett |
| 2003/0230941 | A1 | 12/2003 | Jacobs |
| 2004/0262127 | A1 | 12/2004 | Harnish et al. |
| 2005/0220582 | A1 | 10/2005 | Kumagai et al. |
| 2006/0207220 | A1 | 9/2006 | Ford |
| 2007/0119123 | A1 | 5/2007 | Clark et al. |
| 2007/0152458 | A1 | 7/2007 | Guidetti |
| 2008/0000756 | A1 | 1/2008 | Behnke et al. |
| 2008/0196362 | A1 | 8/2008 | Monti |
| 2008/0283361 | A1 | 11/2008 | Martini et al. |
| 2009/0229227 | A1 | 9/2009 | Raudat et al. |
| 2010/0084247 | A1 | 4/2010 | Wipf et al. |
| 2010/0140052 | A1 | 6/2010 | Martini |
| 2010/0192515 | A1 | 8/2010 | Chalendar et al. |
| 2011/0150610 | A1 | 6/2011 | Weber |
| 2011/0154784 | A1 | 6/2011 | Poutot |
| 2011/0173930 | A1 | 7/2011 | Poutot |
| 2012/0085623 | A1 | 4/2012 | Wipf |
| 2012/0261233 | A1 | 10/2012 | Huettner et al. |
| 2014/0262685 | A1 | 9/2014 | Job et al. |
| 2014/0299445 | A1 | 10/2014 | Kolb |
| 2014/0377049 | A1 | 12/2014 | Girtman |
| 2015/0001041 | A1 | 1/2015 | Barber et al. |
| 2015/0063963 | A1 | 3/2015 | Kinugawa |

(56) References Cited

U.S. PATENT DOCUMENTS

| | | | |
|---|---|---|---|
| 2015/0139772 | A1 | 5/2015 | Rapp et al. |
| 2015/0158611 | A1 | 6/2015 | Kalany et al. |
| 2015/0321857 | A1 | 11/2015 | Sacchetti et al. |
| 2015/0360801 | A1* | 12/2015 | Sytema ..... B65B 49/16 53/74 |
| 2016/0068290 | A1 | 3/2016 | Bonnain et al. |
| 2016/0107782 | A1 | 4/2016 | Hutter et al. |
| 2018/0186579 | A1 | 7/2018 | Choplin |
| 2018/0222608 | A1 | 8/2018 | Hutter et al. |
| 2019/0233151 | A1 | 8/2019 | Ford et al. |
| 2019/0255698 | A1 | 8/2019 | Zeiner et al. |
| 2020/0189779 | A1 | 6/2020 | Canalicchio et al. |
| 2020/0207491 | A1* | 7/2020 | Koet ..... B31B 50/741 |
| 2020/0290815 | A1 | 9/2020 | Papsdorf et al. |
| 2020/0290816 | A1 | 9/2020 | Papsdorf et al. |
| 2021/0139176 | A1 | 5/2021 | Bonnain |

FOREIGN PATENT DOCUMENTS

| | | | |
|---|---|---|---|
| CN | 202729327 | U | 2/2013 |
| CN | 105984601 | A | 10/2016 |
| CN | 108674883 | A | 10/2018 |
| CN | 208216241 | U | 12/2018 |
| CN | 108454224 | B | 6/2020 |
| DE | 1236531 | B | 3/1967 |
| DE | 2046707 | A1 | 4/1971 |
| DE | 3709046 | C1 | 10/1988 |
| DE | 4208818 | A1 | 9/1993 |
| DE | 19602358 | C1 | 3/1997 |
| DE | 19628563 | A1 | 1/1998 |
| DE | 10121038 | A1 | 10/2002 |
| DE | 10346415 | A1 | 5/2005 |
| DE | 202005006755 | U1 | 10/2005 |
| DE | 102004026455 | A1 | 12/2005 |
| DE | 102005014863 | A1 | 10/2006 |
| DE | 202010001712 | U1 | 6/2011 |
| DE | 102011076864 | A1 | 12/2012 |
| DE | 102011015741 | B4 | 1/2013 |
| DE | 102011081705 | A1 | 2/2013 |
| DE | 102011085724 | A1 | 5/2013 |
| DE | 102014105998 | A1 | 2/2015 |
| DE | 102014103632 | A1 | 9/2015 |
| DE | 102015203412 | A1 | 9/2015 |
| DE | 102015114654 | A1 | 3/2017 |
| DE | 102016212227 | A1 | 1/2018 |
| DE | 102016212237 | A1 | 1/2018 |
| DE | 102016121361 | A1 | 5/2018 |
| DE | 202018103487 | U1 | 8/2018 |
| DE | 102016105570 | B4 | 1/2019 |
| DE | 102019107313 | A1 | 9/2020 |
| DE | 102020107427 | A1 | 9/2020 |
| DE | 102019204393 | A1 | 10/2020 |
| EP | 0149146 | A2 | 7/1985 |
| EP | 0439741 | A1 | 8/1991 |
| EP | 0496046 | B1 | 1/1995 |
| EP | 0813494 | B1 | 9/1999 |
| EP | 1231145 | A1 | 8/2002 |
| EP | 1123886 | B1 | 8/2004 |
| EP | 1522402 | B1 | 6/2006 |
| EP | 1327591 | B1 | 11/2006 |
| EP | 1790593 | A1 | 5/2007 |
| EP | 1067048 | B1 | 8/2008 |
| EP | 2014559 | A1 | 1/2009 |
| EP | 1645340 | B1 | 10/2010 |
| EP | 2192063 | B1 | 4/2012 |
| EP | 2757043 | A1 | 7/2014 |
| EP | 2673224 | B1 | 1/2015 |
| EP | 2560904 | B1 | 4/2015 |
| EP | 2484611 | B1 | 9/2015 |
| EP | 2500296 | B1 | 2/2016 |
| EP | 2634100 | B1 | 2/2016 |
| EP | 2921433 | B1 | 9/2016 |
| EP | 3034415 | B1 | 3/2017 |
| EP | 3034441 | B1 | 4/2017 |
| EP | 3024737 | B1 | 7/2017 |
| EP | 2980010 | B1 | 8/2017 |
| EP | 2861496 | B1 | 9/2017 |
| EP | 3022138 | B1 | 10/2017 |
| EP | 3038959 | B1 | 11/2017 |
| EP | 2848382 | B1 | 12/2017 |
| EP | 2736834 | B1 | 2/2018 |
| EP | 3003927 | B1 | 3/2018 |
| EP | 3266718 | B1 | 7/2018 |
| EP | 3109998 | B1 | 8/2019 |
| EP | 3363751 | B1 | 4/2020 |
| EP | 3659932 | A2 | 6/2020 |
| EP | 3251986 | B1 | 1/2021 |
| EP | 3230181 | B2 | 7/2021 |
| EP | 3422562 | B1 | 10/2021 |
| FR | 3088842 | A1 | 5/2020 |
| GB | 1299116 | A | 12/1972 |
| GB | 1340427 | A | 12/1973 |
| GB | 2434356 | A | 7/2007 |
| IT | BO990370 | A1 | 1/2001 |
| IT | BO990484 | A1 | 3/2001 |
| JP | S54128282 | U | 9/1979 |
| JP | S6277149 | U | 5/1987 |
| JP | H05254644 | A | 10/1993 |
| JP | 2011025392 | A | 2/2011 |
| JP | 2018184294 | A | 11/2018 |
| WO | WO99036317 | A2 | 7/1999 |
| WO | WO00068087 | A2 | 11/2000 |
| WO | WO01085581 | A1 | 11/2001 |
| WO | WO2004024401 | A1 | 3/2004 |
| WO | WO2005070768 | A1 | 8/2005 |
| WO | WO2006098556 | A1 | 9/2006 |
| WO | WO2007033267 | A2 | 3/2007 |
| WO | WO2008036754 | A2 | 3/2008 |
| WO | WO2010120869 | A1 | 10/2010 |
| WO | WO2011127367 | A1 | 10/2011 |
| WO | WO2011138448 | A1 | 11/2011 |
| WO | WO2012057996 | A2 | 5/2012 |
| WO | WO2013005120 | A1 | 1/2013 |
| WO | WO2013185954 | A1 | 12/2013 |
| WO | WO2014072518 | A2 | 5/2014 |
| WO | WO2014118631 | A1 | 8/2014 |
| WO | WO2014187543 | A1 | 11/2014 |
| WO | WO2015101862 | A1 | 7/2015 |
| WO | WO2016012158 | A1 | 1/2016 |
| WO | WO2016012159 | A1 | 1/2016 |
| WO | WO2016069190 | A1 | 5/2016 |
| WO | WO2016069457 | A1 | 5/2016 |
| WO | WO2016146213 | A1 | 9/2016 |
| WO | WO2016188843 | A1 | 12/2016 |
| WO | WO2016200753 | A1 | 12/2016 |
| WO | WO2017167421 | A1 | 10/2017 |
| WO | WO2018049125 | A1 | 3/2018 |
| WO | WO2018144552 | A1 | 8/2018 |
| WO | WO2018145214 | A1 | 8/2018 |
| WO | WO2018161160 | A1 | 9/2018 |
| WO | WO2018193218 | A1 | 10/2018 |
| WO | WO2019007923 | A1 | 1/2019 |
| WO | WO2019129968 | A1 | 7/2019 |
| WO | WO2020126218 | A1 | 6/2020 |
| WO | WO2020146486 | A1 | 7/2020 |
| WO | WO2020244951 | A1 | 12/2020 |

OTHER PUBLICATIONS

All Packaging Company, "Folding Carton continuous printing at up to 20k sheets per hour," <https://www.youtube.com/watch?v=Bc8ZnHukvNO> YouTube publication date Mar. 3, 2013.

Bastian Solutions, "High-Speed Pick & Place Robots by Basitan Solutions," <https://www.youtube.com/watch?v=6RKXVefE98w> YouTube publication date Apr. 3, 2012.

BluePrint Automation, "20237 BluePrint Automation (BPA) Robotic Pick & Place Case Packer (Model: Robotic Top Loader," <https://www.youtube.com/watch?v=RjxTeuyaH_Q> YouTube publication date Apr. 13, 2012.

Bobst, "Bobst Ambition folder-gluers," <https://www.youtube.com/watch?v=EvLkFkz-Uv0> YouTube publication date Jan. 29, 2015.

(56) References Cited

OTHER PUBLICATIONS

Packagingspace, "Cama Group complete packaging lineup.mpg," <https://www.youtube.com/watch?v=6uTnz59b4H8> YouTube publication date May 16, 2011.
Packfeeder, "Robotic bottle unscrambler—Pickfeeder Twin 200," <https://www.youtube.com/watch?v=ueiOqVip7-c> YouTube publication date Dec. 11, 2018.
Professional Packaging Systems, "A-B-C 450 High Speed Case Erector and Bottom Sealer / ProPac.com," <https://www.youtube.com/watch?v=w6w9psSstKA> YouTube publication date Sep. 3, 2010.
STAX Technologies, "Case packer + palletizer," <https://www.youtube.com/watch?v=YtNft4FYkDw> YouTube publication date May 6, 2015.
International Search Report and Written Opinion for Application No. PCT/EP2020/071379 dated Nov. 5, 2020 (10 pages).
International Preliminary Report on Patentability for Application No. PCT/EP2020/071379 dated Feb. 10, 2022 (8 pages).
Office Action received for Chinese Patent Application No. 202080068728.1, mailed on Apr. 28, 2023, 17 pages (8 pages of English Translation and 9 pages of Original Document).

* cited by examiner

PACKAGING APPARATUS FOR SECONDARY PACKAGES

CROSS REFERENCE TO RELATED APPLICATIONS

This application is a national stage filing under 35 U.S.C. § 371 of International Patent Application No.: PCT/EP2020/071379, filed Jul. 29, 2020, which claims priority to European Patent application Ser. No. 19/189,079.7, filed Jul. 30, 2019 and European Patent Application No. 19219726.7, filed Dec. 26, 2019, the entire contents of which all are hereby incorporated by reference herein.

TECHNICAL FIELD

The present invention relates to in-line wrapping of a foldable blank around a load that is simultaneously received onto the loading space of the foldable blank.

BACKGROUND

In the recent years, there has been a many-fold increase in the trend of grouping large number of items such as food items, including liquid foods, home essentials, stationary items, beverage containers, and the like, into secondary packages, for various purposes such as to enable bulk selling, easy transportation, handling, and the like.

Particularly, there has been a considerable increase in use of folding box-based packages e.g. for holding various articles and therefore the number of boxes that are manufactured is increasing consistently. These packages are generally formed from foldable blanks which are folded using one or more folding mechanisms to obtain the secondary package having the desired shape and size.

Numerous folding mechanisms have been proposed. In some instances, these foldable blanks are provided with score lines, fold-lines and/or cut-outs to form wall corner portions or joining portions to form a wall or corner.

One such mechanism is disclosed within U.S. Pat. No. 3,841,476, which discloses the use of a pre-cut blank of cardboard or like material to form a tray shape package. The blank is scored and provided with cut-outs to form wall corner portions and uniting portions at the ends of corresponding first wall forming portions and also to form strengthening tabs. The tray is erected by first erecting the strengthening tabs and by then erecting the first and second wall forming portions and finally bending the corner portions and uniting portions so that the latter can be secured to the second wall forming portions. However, the package formed using scoring/folding line techniques has certain limitations such as first, a special tool is required to create the fold lines and then another folding tool is required to form the package. Further, such mechanism allows only a single predetermined shape and size of packaging blanks to be created.

On the other hand, current packaging mechanisms involves a process of picking up a group of articles from an infeed supply and then dropping into already formed packages supplied onto another conveying line. Accordingly, such a process first requires assembling or erecting the packaging blanks of predetermined sizes, then receiving the group of articles therein, and then closing the package. These predetermined packaging blanks are generally adapted to receive articles arranged in predetermined groups, configurations and/or patterns.

Unfortunately, if the predetermined configuration, pattern and/or number of articles in a group needs to be changed, the packaging mechanism must be converted to cope with the changed packaging configuration. Consequently, the overall packaging process, accommodating various package configurations becomes highly inefficient in terms of cost as well as complexity of the packaging process.

It would therefore be beneficial if the conversion of the packaging mechanism, to accommodate changing configurations, patterns and/or number of articles in a group, would not affect the overall packaging efficiency. To this end, the present invention beneficially allows articles to be dropped into a package while at the same time said package is being formed by means of erecting the packaging blank.

None of the existing solutions in the art completely provide the flexibility of using a same packaging machine for varying configurations, shapes and numbers of articles to be packaged within a (secondary) packaging, while the packaging blanks for the packaging are formed the moment they are loaded with articles.

SUMMARY

In an aspect of the invention, a packaging apparatus is provided for forming a package from a foldable blank, said foldable blank having a bottom panel extended towards a plurality of side panels including a first side panel, a second side panel, front panels and back panels, is provided. The packaging apparatus includes a support means adapted to receive a supply of one or more foldable blanks. The support means includes a support frame supported onto two or more parallel longitudinal rails positioned generally transversal to a direction of supply of foldable blanks. The apparatus further includes an article loading mechanism to load a group of articles onto a loading space defined onto the foldable blank received onto the support means. The apparatus furthermore includes an erecting mechanism having a plurality of generally spaced apart vertical lugs, positioned onto one or more sides of the support frame, and at a height lower than the height of longitudinal rails such that a vertically upward movement of the lugs engages and erects at least one side of the foldable blank around the articles already loaded onto the foldable blank.

Generally, the support means is movingly positioned onto an open or closed loop curvilinear track through one or more support movers movingly configured thereon. Preferably, the curvilinear track is closed.

Generally, the packaging apparatus may further include a pair of downwardly protruding movingly spaced apart transverse rails adapted to define the loading space onto the foldable blank in accordance to a predetermined configuration of the article(s) to be packaged within the secondary package.

The support means may include a support frame with variable width adapted to support foldable blanks of varying dimensions.

In an embodiment, the width of the support frame may be adapted, manually or automatically, in accordance with varying dimensions of the foldable blank, by moving the longitudinal rails towards and/or away from each other.

Further, the support frame may include a pair of finger sets, each supported onto one of the longitudinal rails.

Yet further, each of the finger set may include a plurality of generally parallel spaced apart fingers having a predetermined space between consecutive fingers adapted to movingly receive at least one finger of the other set of fingers.

Yet further, a horizontal movement of the longitudinal rails in a direction towards and/or away each other onto the closed loop conveyor may facilitate a movement of the pair of fingers set between an overlapping configuration and a non-overlapping configuration.

In another embodiment in accordance with the present invention, the support frame may be foldable or collapsible upon moving the longitudinal rails towards each other.

Such foldable or collapsible support frame may comprise a foldable or collapsible deck comprising a plurality of parallel elongated segments moveable configured transversal to the direction of supply of foldable blanks.

In another embodiment, the foldable or collapsible support deck may be further supported horizontal by one or more sets of a plurality of segments moveable configured by lattice linkages.

In another embodiment as illustrated in FIG. 10, the support frame may comprise a foldable or collapsible deck comprising a foldable origami-like, or Miura fold-based support structure support structure. The foldable or collapsible support deck may be supported horizontal by one or more sets of origami-like, or Miura fold-based structures configured hinged or otherwise interlocked material facets arranged into a foldable three dimensional load bearing structure which adjusts to the width of the deck while continually ensuring load bearing support. The structure may be made of rigid polymers or stainless steel.

In another embodiment, the foldable deck may receive the articles (eg. Beverage Cans) to be packed directly onto the deck surface without the presence of a packaging blank, should said articles be packaged via a top applied packaging retention system.

Preferably, the article loading mechanism includes a gripper set adapted to pick up a group of articles such as e.g. beverage containers from a first conveying line, arranged in a predetermined configuration, and to drop the already picked up beverage containers onto the loading space of the foldable blank.

Alternatively, the article loading mechanism may be any conventionally known mechanism suitable for picking up a set of articles from a supply of articles and dropping onto the loading space of the foldable blank.

The foldable blank may be formed of any foldable material such as carton, paperboard, thermoplastics, hybrid material, and the like.

Further, the foldable blank may include one or more side flaps configured onto at least one of the side panels, and further including one or more engaging mechanisms for closing the side flaps.

Yet further, the said engaging mechanisms may be any suitable attaching and/or locking means selected from one or more of but not limited to gluing means, adhesive patches, notch-based locking, and the like.

Yet furthermore, the plurality of vertical or inclined to the vertical acting lugs of the erecting mechanism may be pitch adjustable that they act opposite the centerlines of the articles, eg. beverage containers, loaded onto the support frame.

The packaging apparatus may also include one or more locating means for positioning and locating the foldable blank onto the support means.

Further, the locating means may include one or more pushing lug configured towards a receiving end of the support means and adapted to push the foldable blank thereon to the support frame.

The locating means may also include one or more corner lugs adapted to support the foldable blanks at the corners of the support frame such that falling of the foldable blank is avoided.

Further, foldable blank locating means may be included being a pair of location pins integrated into the support frame to precisely locate the foldable blank upon deposition onto the support frame.

In an embodiment, preferably in addition to locating means, a series of suction cups, preferably independently activated, is incorporated into the support frame at either side of the frame. Once the suction cups are activated and the foldable blank securely held onto the support frame, the location pins may be retracted.

The open or closed loop linear conveyor may include a movement mechanism for enabling a horizontal movement of the longitudinal rails onto the conveyor.

Further, the movement mechanism may include one or more movers each configured to movingly engage at least such that movement of the movers onto the open or closed loop linear conveyor enables a movement of the corresponding longitudinal rails.

Particularly, the packaging apparatus is configured onto an incoming conveying line adapted to deliver the supply of foldable blanks to the receiving end of the support means.

The open or closed loop linear conveyor, the transversal rails, the longitudinal rails, and the article loading mechanism may be preferably adapted to continuously move at a predetermined pitch so as to convert the supply of foldable blanks into loaded cartons of the desired size continuously. If required, it may be adapted to also move intermittently at a variable pitch as required, so as to convert the supply of foldable blanks into loaded cartons packages of the desired size intermittently.

The packaging apparatus may include a first powering means for enabling a movement of the transversal rails and the article loading mechanism.

Said first powering means may comprise one or more servo motors or linear motors.

Alternatively, the first powering means may be selected from one or more of, but not limited to, various conventionally known asynchronic motors, machines, servo drives, and the like conventionally known in the art.

Preferably, each of the plurality of support movers may be individually powered by a second powering means, and in particular a linear motor, utilizing each of the movers as a rotor thereof and the corresponding track as a stator thereof. Alternatively, the second powering means may comprise any other type of driving means adapted to curvilinearly propel each support means in an independent and controlled way.

Optionally, the packaging apparatus further includes a control unit for optimizing the movement of the incoming conveying line, the open or closed loop linear conveyor, the transversal rails, the longitudinal rails, the article loading mechanism, and the erecting mechanism.

Further such control unit may be adapted to optimize the movement of the plurality of support movers so as to longitudinally move the longitudinal rails, and therefore the support means onto the open or closed loop linear conveyor.

As such, the packaging apparatus according to the present invention allows an in-line packaging wrapping of a foldable blank around a receiving load that is simultaneously dropped onto the loading space of the foldable blank, and in particular allowing continuous in-line packaging wrapping In yet another aspect of the invention, a method of packaging articles is provided, by forming a (secondary)

package from a foldable blank around loaded articles wherein the packaging formation and the article loading occur simultaneously or in a coordinated way. The method includes receiving one or more foldable blanks at the receiving end of the support means, each of the foldable blank having a bottom panel extended towards a plurality of side panels.

The method may further include automatically adapting the width of the support frame of the packaging apparatus in accordance with the dimensions of the foldable blank by moving the longitudinal rails towards and/or away from each other. The method furthermore includes positioning, orienting and locating the foldable blank onto the support frame by pushing the blank onto the support frame such that the corners of the foldable blank are supported by the corner lugs.

Moreover, the method may include defining a loading space onto the foldable blank using the one or more pairs of downwardly protruding transversal rails. As such, the method according to the present invention allows an in-line packaging wrapping of a foldable blank around a receiving load that is simultaneously dropped onto the loading space of the foldable blank.

Additionally, the method may include receiving the set of articles onto the loading space and thereafter erecting one or more sides of the foldable blank using the erecting mechanism. Moreover, the method includes moving the support means horizontally onto the open or closed loop linear conveyor such that the front and/or back end of the foldable blank is erected by the contact of the pair of generally sloping static rails.

Optionally, the method includes closing the engaging means using the vertical lugs of the erecting mechanism.

Details and other aspects, features and advantages of the subject matter disclosed herein will be apparent from the description, the drawings, and the claims.

DETAILED DESCRIPTION

The present application discloses a packaging apparatus, for forming a package of a desired dimension around a plurality of articles or items including e.g. liquid foods, home essentials, stationary items, and the like. The packaging tool while being efficient, is able to form packages of different sizes instantly and in accordance with the incoming load being dropped on the load space thereof, without requiring any functional changes in the mechanical elements of the packaging tool. Further, the packaging tool is configured to receive articles onto the foldable blank and change its fold lay-out by automatically adapting the configurations of the apparatus in accordance with the incoming load. Alternatively the packaging tool may receive the incoming load directly onto the support frame, optionally in combination with a top applied means of article retention in a package in a downstream operation. While the secondary package in the context of the present invention may generally be a box shaped container formed of a foldable blank adapted to hold articles (e.g. such as beverage containers), it should be understood that the embodiments of the present invention may be applied in combination with various types, design and utilities of such packages, irrespective of size, shape and materials.

Figure 1:
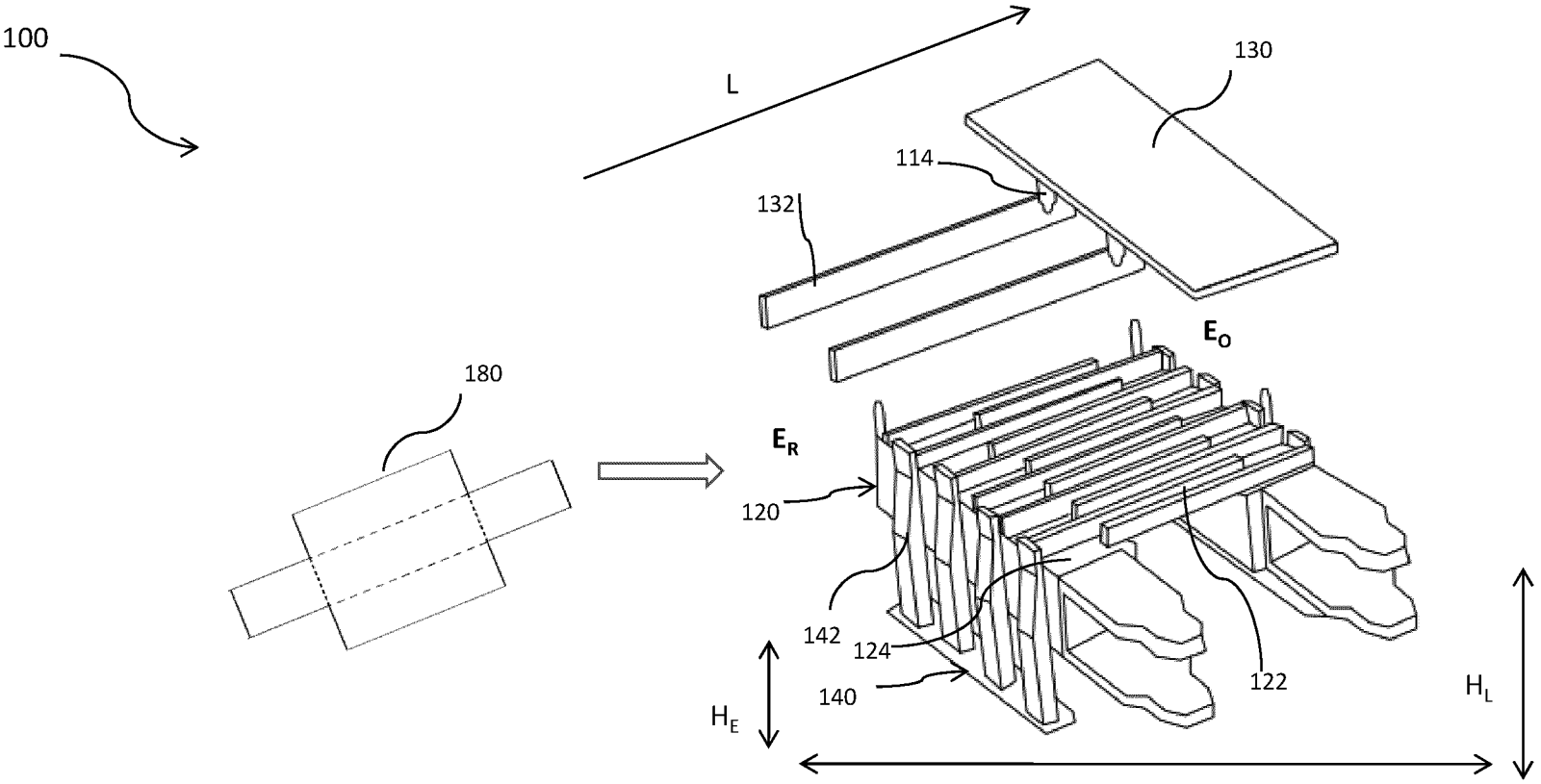
FIG. 1 illustrates a schematic diagram representing a packaging apparatus, in accordance with a preferred embodiment of the present invention.

FIG. 1 illustrates a schematic diagram displaying basic components of the packaging apparatus of the present invention. As illustrated in FIG. 1, the present invention provides a packaging apparatus 100 for forming a secondary package 150 of a predetermined dimension, from a foldable blank 180. The packaging apparatus 100 includes support means 120 extending between a receiving end $E_R$ towards an output end $E_O$ and adapted to receive a supply of a foldable blanks 180 from an incoming conveying line (not shown). The support means 120 includes a support frame 122 supported onto two or more parallel longitudinal rails 124 positioned generally transversal to a direction L of supply of foldable blanks 180 and adapted to support one of the foldable blank 180 thereon. The packaging apparatus 100 further includes an overhead frame 130 having a pair of downwardly protruding and movingly spaced apart transversal rails 132 configured thereon and adapted to define a loading space 188 onto the bottom panel 182 of the foldable blank 180 positioned onto the support frame 122. The packaging apparatus 100 further includes an article loading mechanism (not shown) adapted to load one or more articles 190, arranged in a predetermined configuration, onto the loading space 188. Additionally, the packaging apparatus includes an erecting mechanism 140. The erecting mechanism 140 includes a plurality of generally spaced apart vertical or near vertical acting pairs of pitch adjustable lugs 142, positioned onto one or more sides of the support frame 120, and at a height $H_E$ lower than a height of longitudinal rails $H_L$ such that a upward movement of the one or more lugs engages, erects and clamps at least one or more wall panels 181 of the foldable blank 180 around the articles 190 already loaded thereon.

In operation, each of the foldable blanks 180 received at the receiving end $E_R$ of the support means 120 is first positioned onto the support frame 122, and defined with the loading space 188 using the pair of transversal rails 132 in accordance to the configuration/dimensions of the articles 190 to be packaged. Thereafter, the articles 190 are received onto the loading space 188 and the plurality of side panels 181 of the foldable blank 180 is erected by the erecting mechanism 140, while being conveyed towards the output end $E_O$.

Figure 2A:
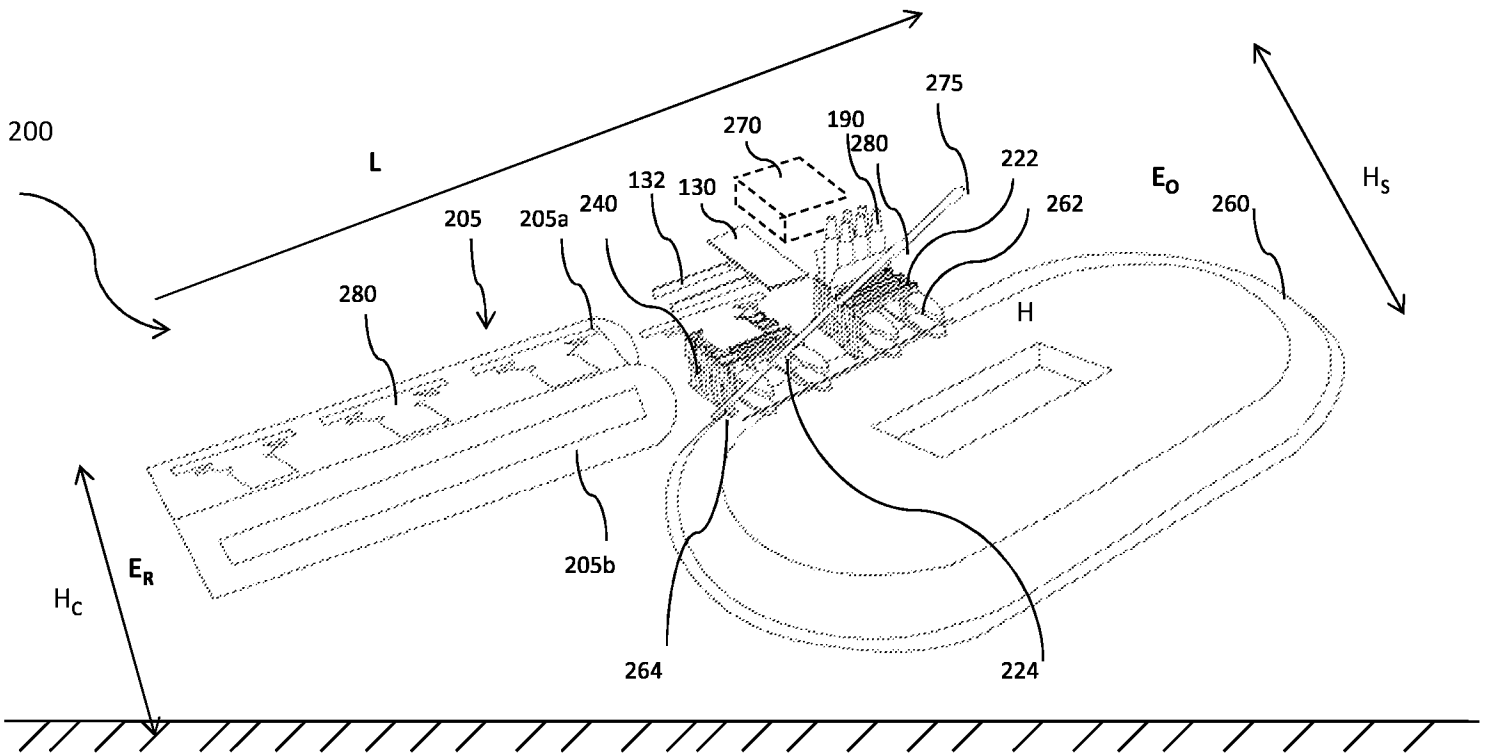
FIG. 2*a* illustrates a schematic diagram representing an exemplary packaging apparatus for formation of packages such as e.g. beverage containers, in accordance with a preferred embodiment of the present invention.

In a preferred embodiment, as illustrated in FIG. 2*a*, an exemplary packaging apparatus 200 having an incoming conveying line 205 carrying a continuous supply of foldable blanks 280 and employed to package a supply of beverage containers 190 within the supply of foldable blanks 280 received at the incoming conveying line 205. The conveying line 205 is generally a conveying apparatus and in preferred embodiment includes two generally parallel circular tracks 205*a*, 205*b* together adapted to facilitate a movement of a supply of foldable blanks 280 from a source such as stack denesting operation [not shown] towards a support means 220 extending between a receiving end $E_R$ towards an output end $E_O$.

Figure 2B:
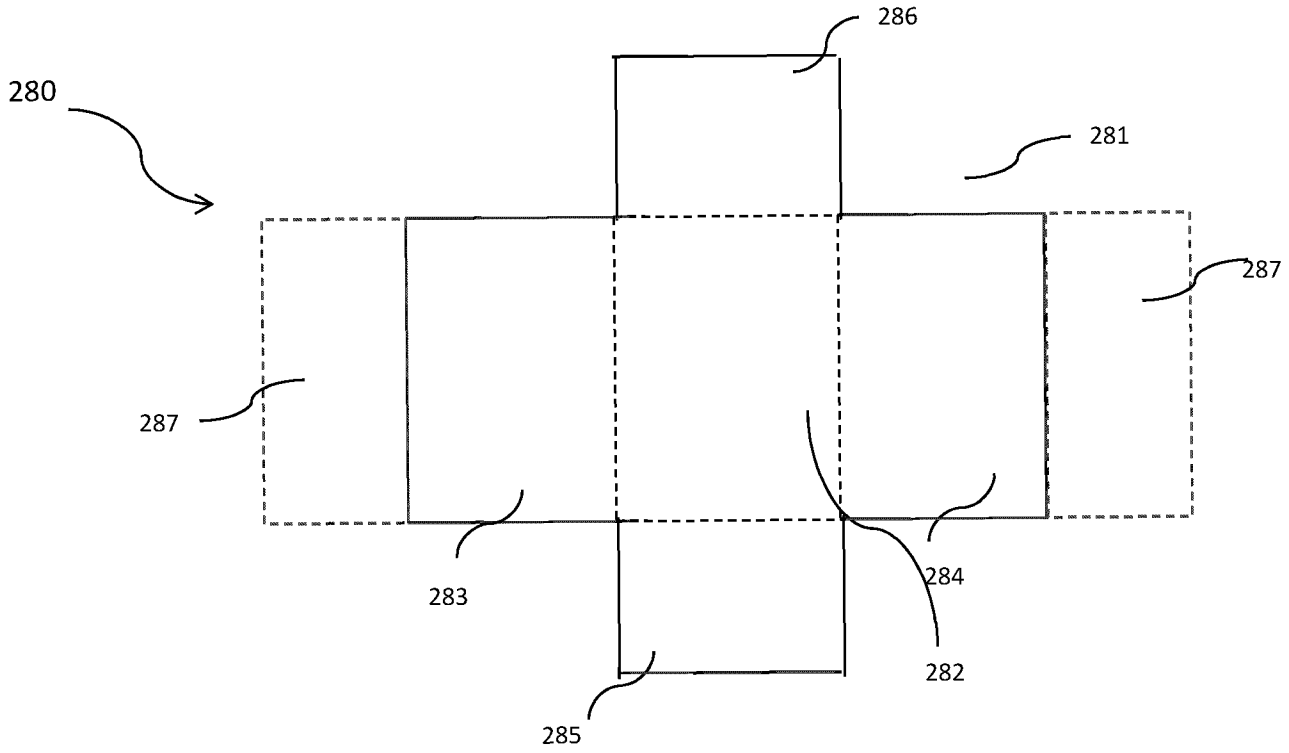
FIG. 2*b* illustrates an exemplary foldable blank, in accordance with a preferred embodiment of the present invention.

An example of a foldable blank suitable for use with the present invention is illustrated in FIG. 2*b*; the foldable blank 280 including bottom panel 282 extended towards a plurality of wall panels 281 including a first side panel 283, a second side panel 284, a front-end panel 285 and a back-end panel 286.

The wall panels 281 of the foldable blank 280 are adapted to be folded around the bottom wall panel 282, to form a secondary package defining an inner surface (not shown) there within, and already filled with beverage containers 290. The foldable blank 280 further includes one or more side flaps 287 on at least one of the one or more side panels 281. In some embodiments, the one or more side flaps 287 of the foldable blank 280 further includes one or more engaging mechanisms (not shown) to close the package 250 from the sides thereof. The engaging mechanism may be selected from one or more of but not limited to notch based fixation mechanism, gluing, adhesive patches, retention tab, rivets, and any other suitable engaging mechanisms particularly which can be closed by an upward pushing force, conventionally known in the art and suitable for use in current invention, without deviating from the scope thereof.

Figure 3:
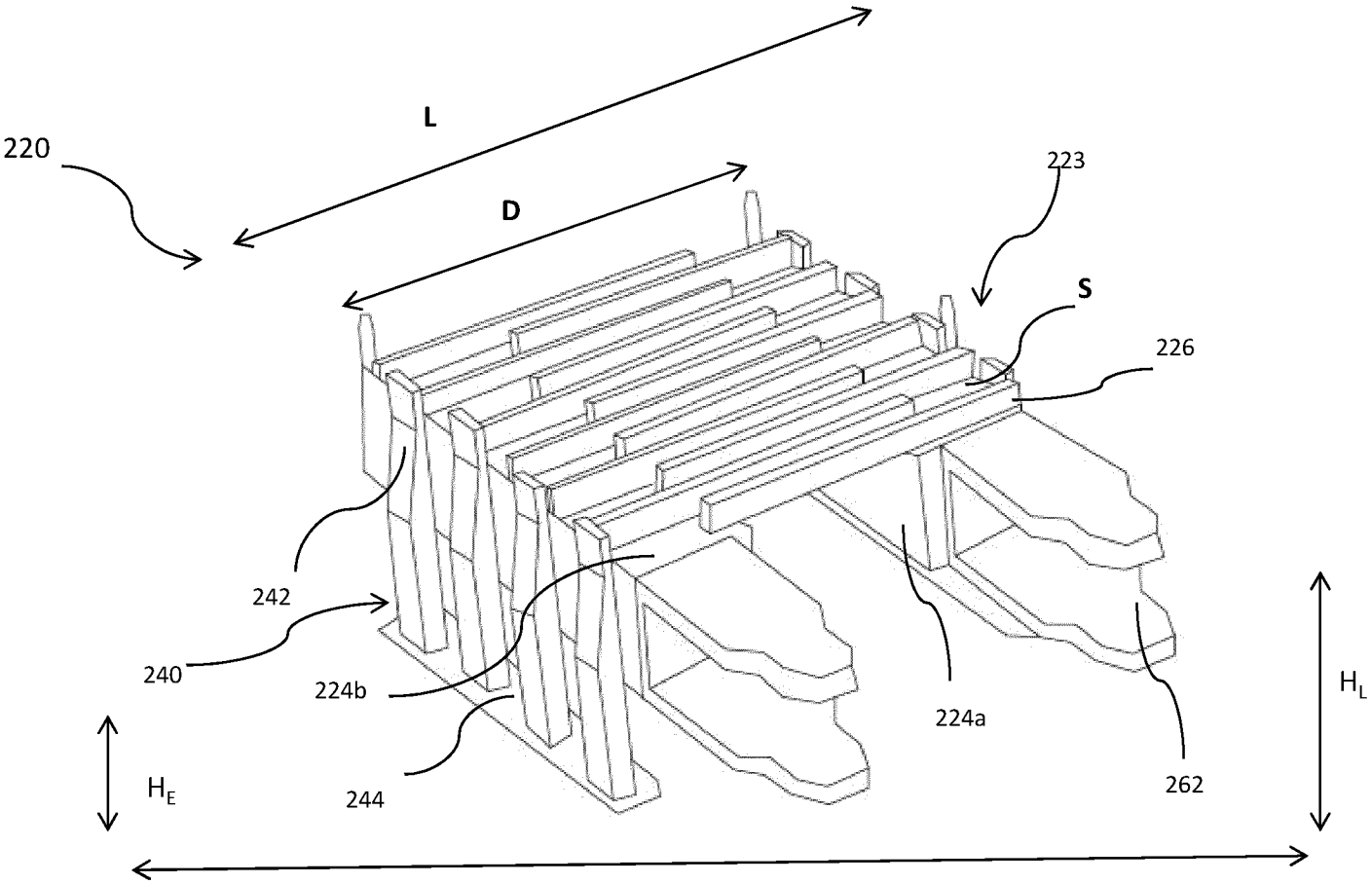
FIGS. 3, 4*a*, 4*b* and 4*c* illustrates a perspective view diagram representing an exemplary support frame in various overlapping and non-overlapping configurations, in accordance with the preferred embodiment of the present invention.

As disclosed earlier and as illustrated in FIG. 3, the packaging apparatus 200 includes the support means 220 adapted to receive the supply of the foldable blank 280 from the incoming conveying line 205. The support means 220 includes a support frame 222 supported onto two or more parallel longitudinal rails 224 including a first longitudinal rail 224*a*, and a second longitudinal rail 224*b*, each positioned generally transversal to a direction L of supply of foldable blanks 180 towards the output end $E_O$, and adapted to support one of the foldable blank 180 thereon.

Figure 4A:
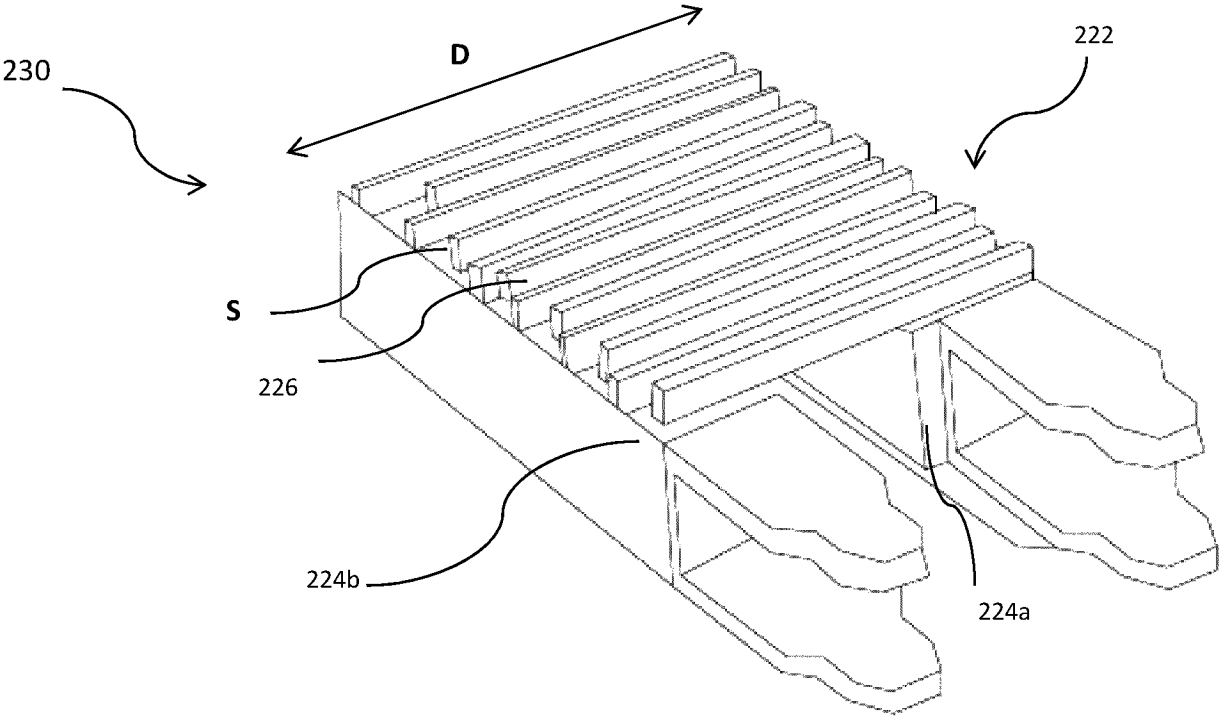
Figure 4B:
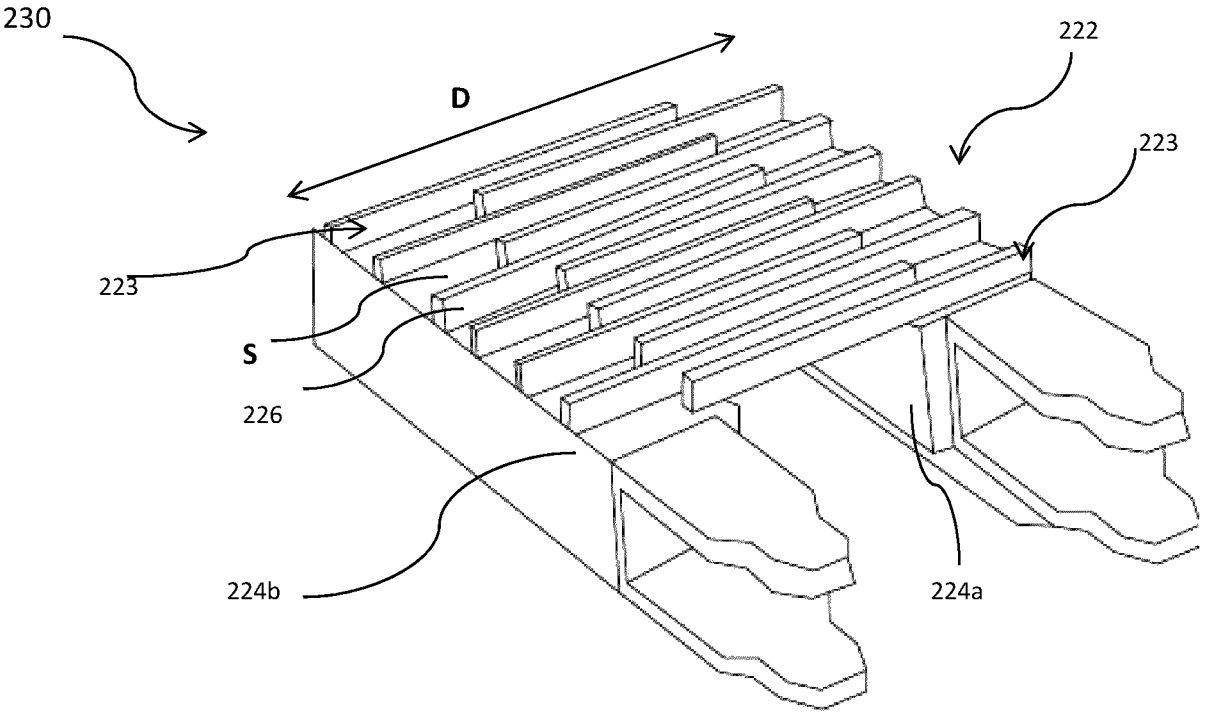
Figure 4C:
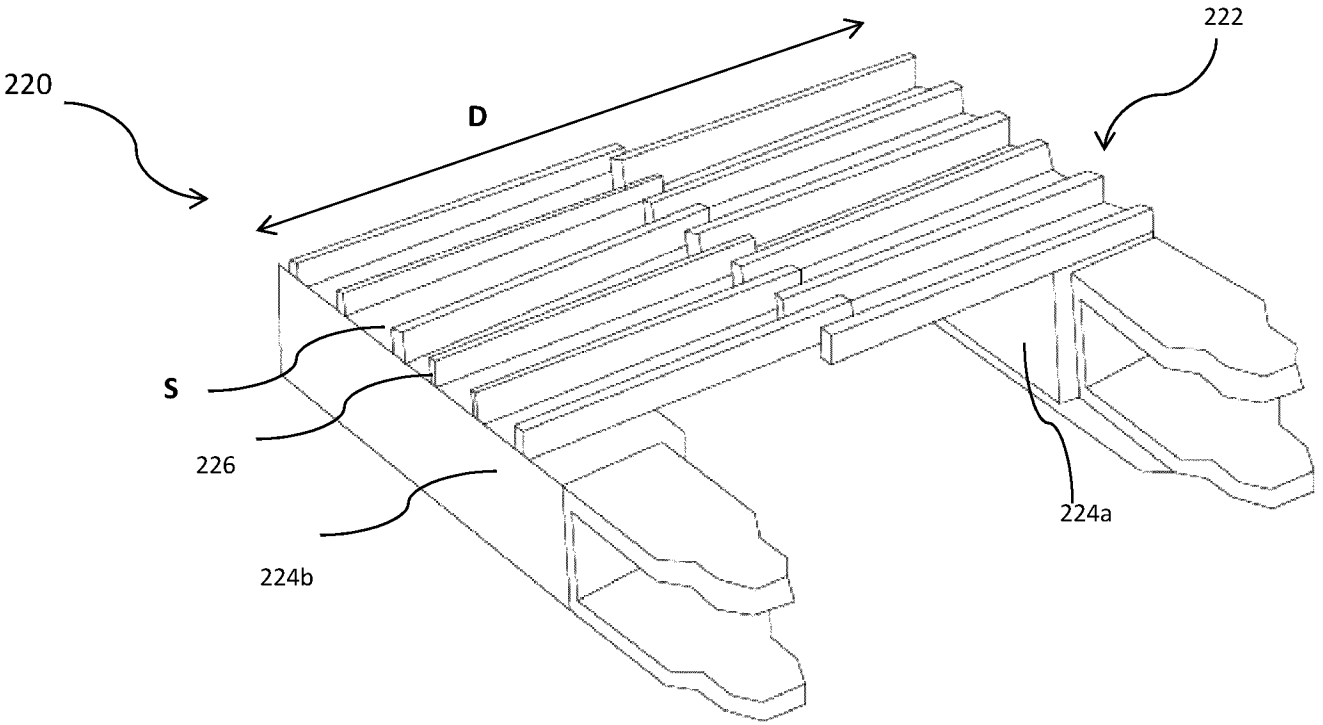

In some embodiments and as illustrated in FIG. 4*a*, 4*b*, 4*c*, the support frame 222 is a frame with variable width adapted to support foldable blanks 280 of varying dimensions D.

In one such embodiment, the support frame 222 includes a pair of finger sets 223, each supported onto one of the longitudinal rails 224. Each of the finger set 223 includes a plurality of generally parallel spaced apart fingers 226 having a predetermined space S between consecutive fingers 226 adapted to movingly receive at least one of the fingers 226 of the other set of fingers 223. The movement of the pair of finger sets 226 is facilitated by a movement of the longitudinal rails 224*a*, 224*b*, towards and/or away from each other. In an embodiment, such a movement of longitudinal rails 224*a*, 224*b* is achieved by a horizontal movement mechanism H. The horizontal movement mechanism H includes a closed loop conveyor 260 adapted to movingly receive the longitudinal rails 224*a*, 224*b* there upon through a plurality of support movers 262, at least one movingly engaged to each of the longitudinal rails 224*a*, 224*b*, such that each of the longitudinal rails 224 is independently movable in a horizontal direction generally parallel to the direction L of supply of foldable blanks, towards and/or away from each other. Such a longitudinal movement of the longitudinal rails 224 enables the movement of the pair of set of fingers 223 towards and away from each other thereby, to facilitate a movement of the pair of finger sets 223 between an overlapping configuration and a non-overlapping configuration as illustrated in FIG. 3, 4*a*, 4*b*, 4*c*.

The longitudinal rails 224*a*, 224*b*, are mounted via hinge points 84 (shown in FIG. 7) off support movers 262 such that as the support movers travers about the curves of the open or closed loop conveyor, via a floating alignment bar, the support members are maintained parallel to each other.

The supporting member alignment bar is configured to slide and allow freedom of adjustment on the support frame width and while also accommodating any inaccuracies of the vertical alignment of the curves in the conveyor, while maintaining the support rails parallel (i.e. perpendicular to the alignment rail).

In another embodiment in accordance with the present invention, the support frame may be foldable or collapsible upon moving the longitudinal rails towards each other.

Figure 7:
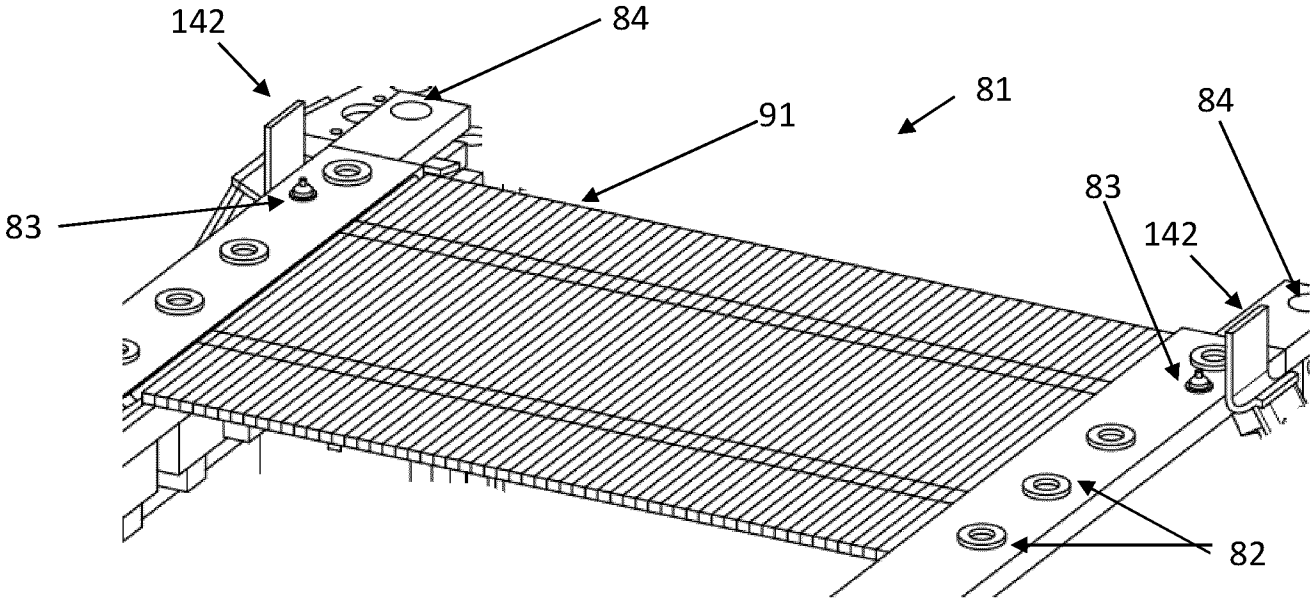
FIG. 7, 8, 9, 10 illustrate examples of foldable or collapsible support frames as may be used in embodiments of the present invention
Figure 8:
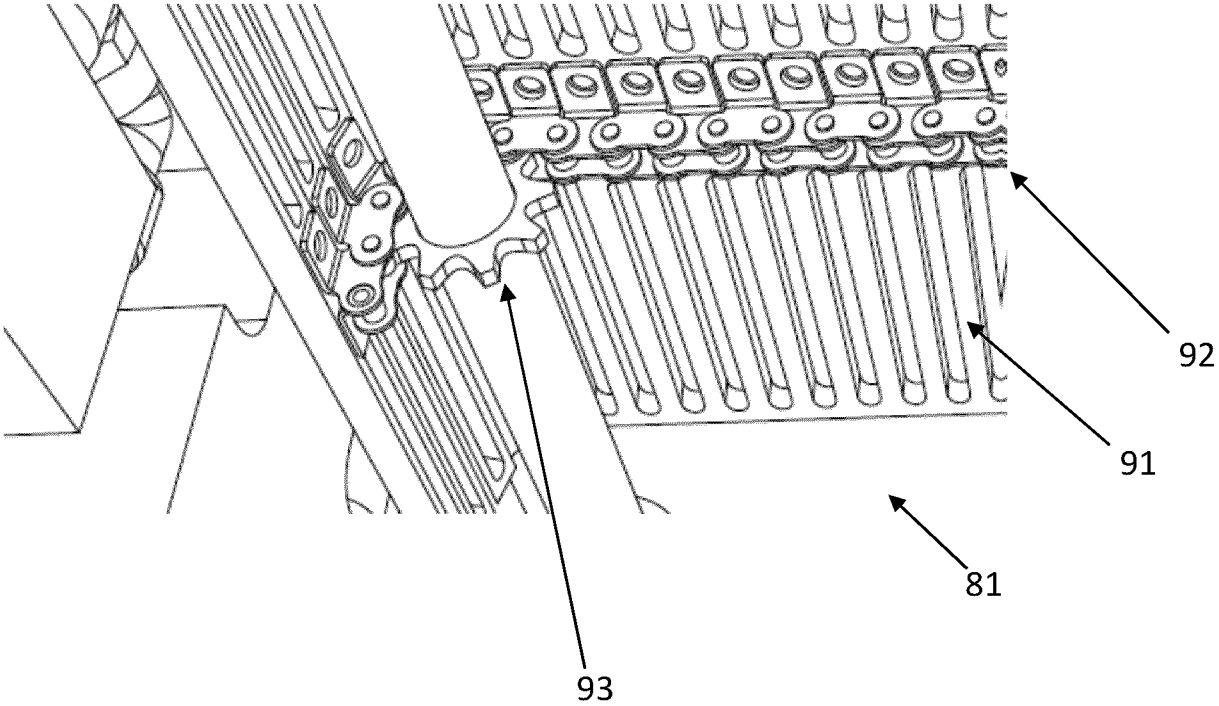

As illustrated in FIGS. 7 and 8, such foldable or collapsible support frame 81 may comprise a foldable or collapsible deck comprising by a plurality of parallel elongated segments 91 moveable configured transversal to the direction of supply of foldable blanks. The foldable or collapsible deck, although made up of multiple segments, when orientated straight and pressed upon in the opposite direction to the freedom to fold direction, forms a flush, load bearing, support surface, void of major gaps or irregularities which may otherwise damage or spoil the materials placed thereon and enable successful support of even tall small diameter articles, such as tall beverage containers, with shallow tipping threshold. In an embodiment the segments may be supported by a chain and sprocket mechanism as shown in FIG. 8. Preferably two or more roller chains 92 with corresponding chain support sprockets 93 enables flexible folding of the support frame upon moving the longitudinal rails towards each other.

Figure 9:
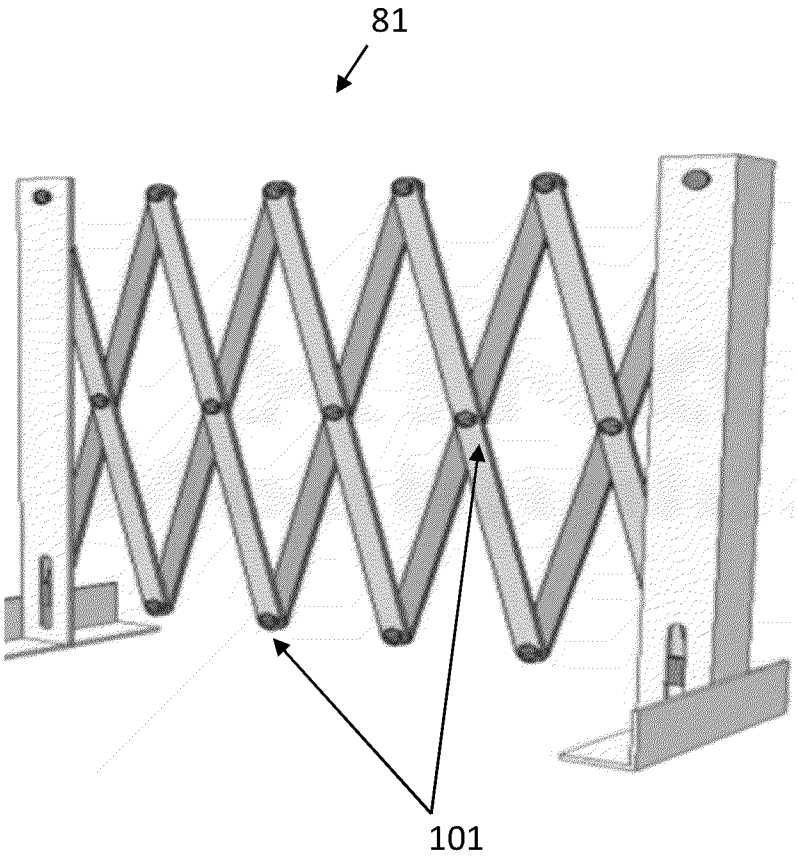
Figure 10:
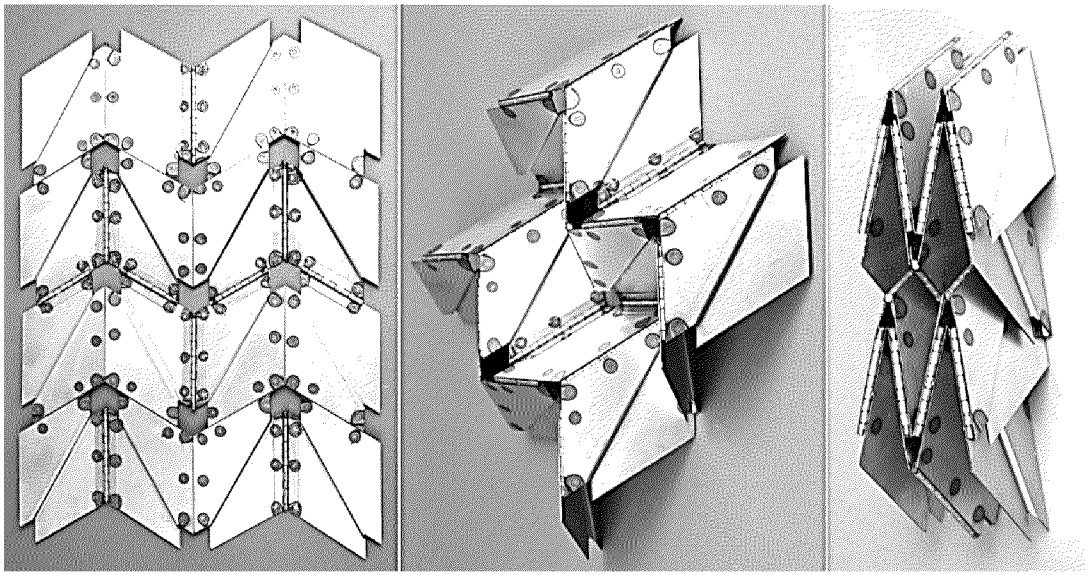

In another embodiment as shown in FIG. 9, the foldable or collapsible support frame 81 may be further supported by one or more folding lattice support mechanisms assuring high load carrying capacity and a truly flat package support deck.

In another embodiment as shown in FIG. ##, alternatively to the lattice linkages, the foldable or collapsible support frame 81 may be further supported by a folding origami-like, or Miura fold-based cell structure assuring high load carrying capacity and a flat package support frame.

Accordingly, the support means 220 is generally a cart kind of structure adapted to be movable onto the closed loop conveyor 260 between the receiving end $E_R$ and the output end $E_O$ through the support movers 262 connected to the longitudinal rails 224.

Figure 5:
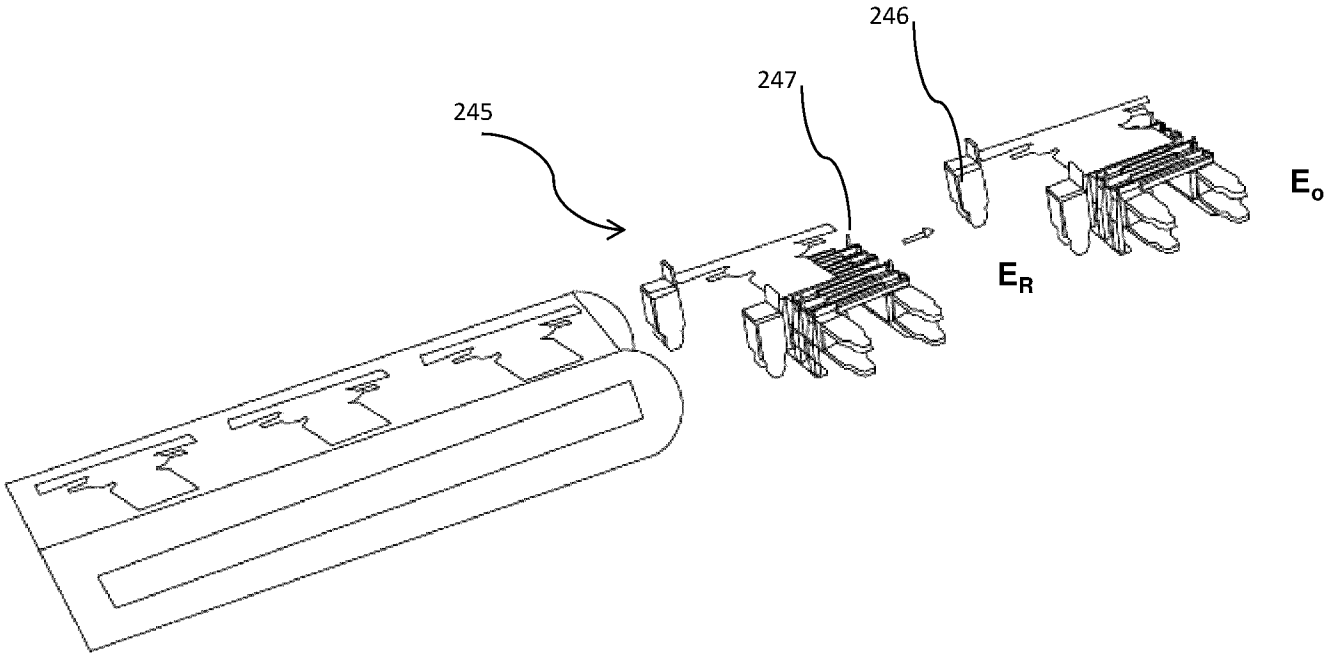
FIG. 5 illustrates a schematic diagram representing an locating mechanism of the packaging apparatus, in accordance with an embodiment of the present invention.

The support frame 222 is generally positioned at a height $H_S$ generally same as a conveying height $H_c$ of the incoming conveying line 205 such that the frame 222 is adapted to receive the foldable blank 280 from the incoming conveyor without requiring any additional transferring means. However, in some embodiments, the support means 222 includes one or more locating mechanisms 245 adapted to properly position the one or more foldable blanks onto the support frame 224. In one such embodiment as show in FIG. 5, the locating mechanism 245 include one or more pushing lugs 246, each configured at the receiving end $E_R$ of the support frame 224. Each of the pushing lugs is generally configured to push an incoming foldable blank 280 such that it is positioned completely onto the support frame 224. Further, the one or more locating mechanism 245, includes one or more corner lugs 247 positioned onto the corners of the support frame and adapted to support the foldable blanks 280 at the corners of the support frame 224 such that falling of the foldable blank 280 is avoided there from.

Alternatively, as shown in FIG. 7, the locating means may include a pair of retractable location pins 83 integrated into the support frame to engage in corresponding apertures in the base panel of the foldable blank and thereby precisely locate the foldable blank upon deposition onto the support frame.

In an embodiment, preferably in addition to locating means, a series of suction cup pairs 82, preferably independently activated by vacuum pumps, is incorporated into the support frame at either side of the frame. Once the suction cups are activated and the foldable blank securely held onto the support frame, the location pins may be retracted.

It should be understood that the use of location pins and suction cups is not limited to foldable and collapsible support frames, but may be used in any type of support frame used in the context of the present invention.

Figure 6:
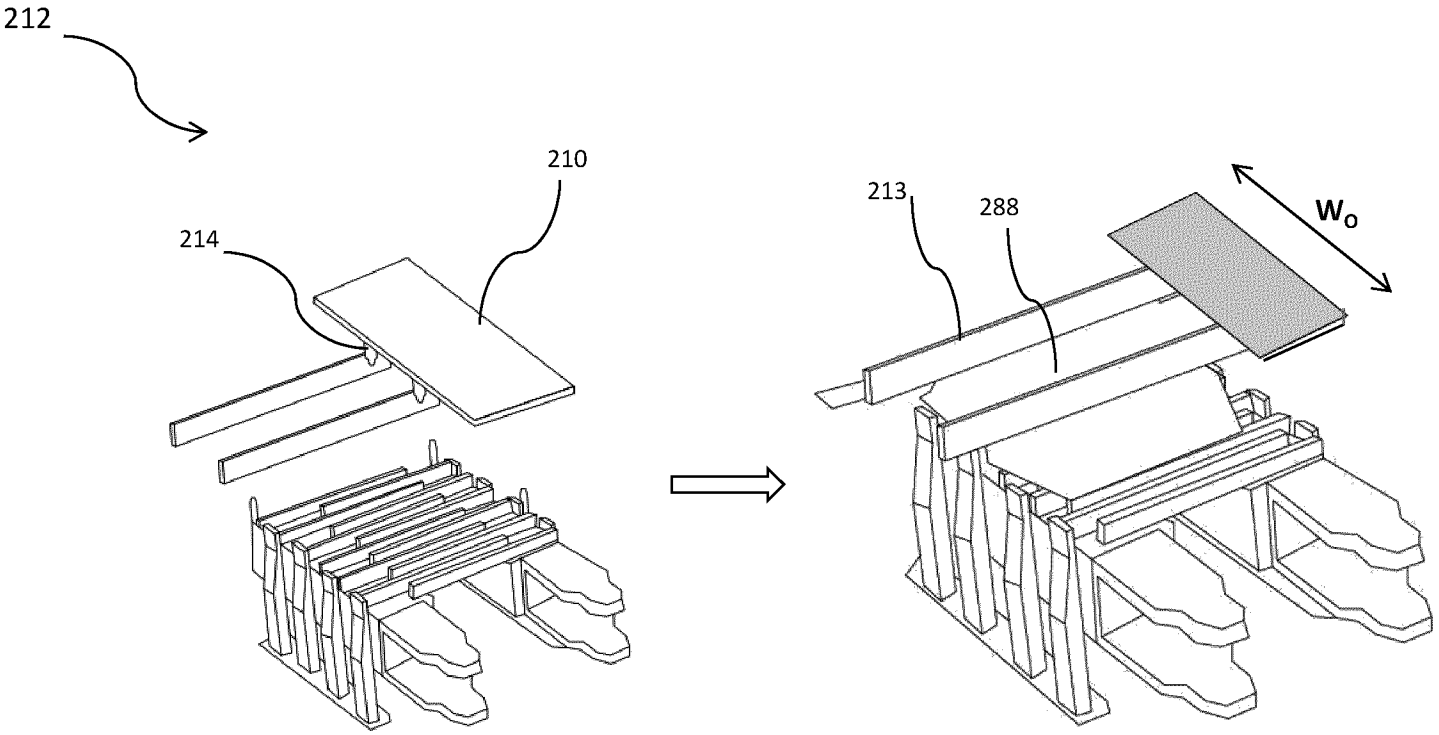
FIG. 6 illustrates an exemplary pair of generally parallel, downwardly protruding, and movingly spaced apart spacing means defining loading space onto a support frame.

As illustrated in FIG. 6, the packaging apparatus 200 further includes one or more pair of generally parallel, downwardly protruding, and movingly spaced apart spacing means 212 configured thereon to an overhead structure 210. The overhead structure 210 is a supporting structure adapted to support the transversal rails thereon and having a width $W_O$. In the illustrated embodiment, the overhead structure 210 is generally in the form a fixed frame. However, in other embodiments, the overhead structure 210 may be in the form of any suitable conventionally known support structure selected from one or more of but not limited to an overhead conveyor, a robotic arm, and the like.

The spacing means 212 is generally a means for defining the loading space 288 on to the foldable blank 280 in accordance to the configuration, arrangement and/or dimensions, of the one or more articles, to be packaged within the (secondary) package 250. In the illustrated embodiment, the spacing means 212 is generally in the form of a pair of movingly spaced apart downwardly protruding transversal rails 213, each movingly connected to the overhead frame 210 through one or more spacing movers 214. The transversal rails 213 are first moved down in contact with the foldable blank 280, and thereafter moved away from each other in accordance to the configuration/arrangement/dimensions, of the one or more articles, to be packaged within the package 250. Alternatively, the spacing means 212 may include any suitable mechanism conventionally known in the art for facilitating such an independent longitudinal movement of the one or more transversal rails 213 longitudinally across the overhead frame 210.

The packaging apparatus 200 further includes one or more article loading mechanisms (not shown) for loading one or more articles 290, arranged in a predetermined configuration, onto the loading space 288.

The article loading mechanisms may be selected from any conventionally mechanism known in the art and suitable for picking and/or releasing articles such as e.g. beverage containers.

The packaging apparatus 200 further includes an erecting mechanism 240 adapted to erect the side panels 281 of foldable blanks 280 around the articles 290 already loaded onto loading space 288 of the bottom panel 282 of the foldable blank 280. In an embodiment, the erecting mechanism 240 includes a plurality of generally spaced apart vertical or near vertical, pitch adjustable, retractable, lugs 242, positioned onto one or more sides of the support frame 222, and at a height $H_E$ lower than the height of longitudinal rails $H_L$ such that a generally upward movement of the one or more individually activated pairs of lugs 242 engages and erects at least one or more wall panels 281 of the foldable blank 280 around the articles 290 already loaded thereon. In some embodiments, the plurality of spaced apart vertical lugs 242 are positioned onto a mounting means 244 having one or more mechanism for independently moving each of the plurality of lugs 242 upwardly and downwardly between a top position T and a bottom position B thereof. Such a movement of the lugs 242 upwardly engages the corresponding side panels 281 and erects it while moving towards its top position T. Further, the independent movement of the lugs 242 enables the need of only the selected lugs 242 to be moved up and/or down in accordance to a width W of the foldable blanks 280. Further in some embodiments, the generally vertical acting lugs 242 further includes means for permanently closing the flaps 287 of the foldable blank by either closing the engaging means, or in some embodiments, gluing the flaps by a gluing means configured thereon to the vertical lugs 242.

In some embodiments, the mounting means 244 is generally configured onto an outer portion O of each of the longitudinal 224 such that the vertical lugs always engage the corresponding side panels 281 during an upward movement thereof. However, in other embodiments, the mounting means 244 may be positioned at any desired position in any possible way so as to erect at least one of the side panels 281 and/or the closing flaps 287 around the articles 290 already loaded onto the foldable blank 280.

The vertical lugs 142 may be not only retractable, but also pitch adjustable such that each pair of lugs are positioned and act on one row of loaded articles from each side of that row. Pitch adjustment per longitudinal rail may be executed via rotation of one common shaft with different pitched scrolls or threaded adjustment between the vertical lugs, on each side of the support frame.

In an embodiment, the vertical lugs may have either fixed inclined actuation (up and down) or the option of being actuated vertically up and/or down, or with an up and outward sweep before moving in to fold up and then clamp vertical, the base minor panels of a foldable blank. The option to sweep out and up before clamping in may also have the feature to be withdrawn vertically down to clear the major panels as they are normally folded in later.

In some embodiments and as illustrated in FIG. 7, the erecting mechanism 270 further includes or more secondary erecting means 225 erecting one or more ends selected from the front-end panel 285 and/or the back-end panel 286 of the foldable blank 280. In a preferred embodiment of the present invention, as illustrated in FIG. 2*a*, the secondary erecting means 225 include two parallel static guiding rails 275, each positioned at opposite sides of the support frame 120 and extending away from the receiving end $E_R$ towards the output end $E_O$ in a generally vertically slanted configuration such that the each of the end panels 285, 286 of the foldable blank 280 gets gradually erected around the corresponding already loaded articles 290, while the support means 220 and in turn the foldable blank 280 already loaded with beverage containers 290, is being conveyed onto the closed loop conveyor 260 from the receiving end $E_R$ towards the output end $E_O$. In an embodiment of the present invention, each of the two or more erecting rails of the erecting means 275 is movingly connected to the closed loop conveyor 260 using one or more erecting movers 264. Alternatively, the two or more erecting rails 275 of the erecting means 270 are positioned, one on each side of the closed loop conveyor 260 using any positioning mechanisms such as a manipulator, robotic arm, and the like. Yet alternatively, the positioning mechanism may include any conventionally known manual manipulation mechanism The packaging apparatus 200 further includes a first powering means (not shown) for enabling a movement of the overhead frame 210, the article loading mechanism 270 (see FIG. 2*a*), and the erecting mechanism 240 including the vertical lugs 242, and various sub-components thereof. In a preferred embodiment, the first powering means comprises one or more servo motors or linear motors adapted to power the overhead frame 210, the article loading mechanism 270, and the erecting mechanism 240 including the vertical lugs 242, at a first predetermined pitch facilitating a continuous operation of each of the component of the packaging apparatus 200 such that the incoming supply of the foldable blanks 280 is continuously formed into packages 250 of the desired dimensions.

Further in some preferred embodiments, the packaging apparatus 200 includes a second powering means (not shown) for enabling a movement of each of the support movers 262, and optionally also the spacing movers 214 and/or the erecting movers 264 along the corresponding tracks. In a preferred embodiment, the second powering means is one or more linear motors or equivalent transportation device allowing independent controlled movement of the movers. In such an embodiment, the linear motor is a generally moving magnet type of motor conventionally known in the art. Further in such embodiments, the linear motor utilizes the corresponding conveying track as a stator and each of the movers as a rotor thereof. In such an embodiment, the conveying tracks include a plurality of coils fixedly arranged in a longitudinal direction within the interior portion thereof. Each of the movers 214, 262, 264 is similar in configuration and is generally in the form of a U shaped magnetic yoke having a permanent magnet positioned therewithin on mutually facing inner sides thereof such that when positioned onto the corresponding tracks, each of the of the yoke forms a magnetic circuit and said stator being positioned between the permanent magnets. Further, each of the counter movers 214, 262, 264 include a sliding mechanism such as a roller, or the like, supported by one or more roller-supporting portions formed at lower ends of the corresponding conveying tracks. In operation when current is passed through the stator, a uniform magnetic field is generated and on the basis of polarity of permanent magnets, a movement of each of the movers 214, 262, 264 is achieved. Further, the speed, direction and other parameters may be controlled in accordance with the direction, intensity, etc. of the flow of the current applied thereupon.

In other embodiments, the movers 214, 262, 264 are utilized as stator whereas the circular tracks are utilized as the rotors. In such an embodiment, each of the movers 214, 262, 264 includes built in coils and each of the corresponding tracks include a plurality of magnets configured thereon in a longitudinal direction such that the movers are able to come into an electromagnetic interaction thereby enabling a movement thereof.

The packaging apparatus 200 may include one or more control unit [not shown] for managing the operations thereof, and particularly for managing the working of the first powering means and/or the second powering means and more particularly the movement of the shaping movers, so as to optimize the of the longitudinal rails 224*a*, 224*b* towards and/or away from each other, as well as the support means 222 through the longitudinal rails 224 at a predetermined pitch. The predetermined pitch is particularly required to be evaluated in the instances where the article loading mechanism is external to system and is not working in accurate sequence of the components of the packaging apparatus 200.

In some embodiments, the control unit may include an input unit for receiving the predetermined dimensions, and in turn details on the loading space 288 of the secondary package 250 to be formed at the support means 220. Further, the control unit may include a plurality of sensors (not shown) for tracking the parameters such as for example, position of the foldable blanks to be formed, width and/or height of the packages, or the like. The control unit may further include a processor unit for processing the data captured by the input unit on the basis of predetermined logics/rules for facilitating the movement of the plurality of movers 214, 262 and 264. The control unit may further include an instruction unit that delivers the instructions to various components such as various powering means, linear motors, motors, driving units, or the like, to facilitate a desired and smooth operation and retention of set pitch between movers from which the frame support rails are mounted.

In some embodiments, the control unit may be provided as a computer program product, such as may include a computer-readable storage medium or a non-transitory machine-readable medium maintaining instructions interpretable by a computer or other electronic device, such as to perform one or more processes.

FIGS. 2 and 3 schematically show the arrangement of the basic components of the packaging apparatus 200 of the present invention. However, in the construction of commercial functional units, secondary components such as couplers, connectors, support structure and other functional components known to one of skill in the field of packaging apparatus and more particularly the packaging apparatus for secondary package for use with conveyor systems, may be incorporated within the packaging apparatus 200. Such commercial arrangements are included in the present invention as long as the structural components and arrangements disclosed herein are present. Accordingly, it is to be contemplated that the packaging apparatus 200 may be configured to be used for any kind of secondary packages of any possible shape as deems possible without deviating from the scope of the current invention.

Foldable blanks suitable for use within the context of the present disclosure may be formed from a (recyclable) material selected from one or more of, but not limited to, all kinds of papers, fiberboard, corrugated board, foldable blanks, hybrid material, light weight plastic materials, thermoplastics including acetal, acrylic, cellulose acetate, polyethylene, polystyrene, vinyl, and nylon, and any combinations thereof. Further, the size including the height, and width of the secondary package 250 to be formed, may be varied depending on the design constraints and requirements for its application. For example, within the instances when the secondary package 250 is adapted to house twelve containers in one layer in a 3×4 arrangement the loading space 288 is dimensioned accordingly. Further, in other instances, the loading space 288 may be sized and shaped to hold containers of a different or same quantity and/or size in single layer or more than one layers, and/or in different row/column arrangements (e.g., 1×4, 2×2, 3×4, 4×6, 2×3×2, 2×6×2, 3×5, 3×5×2 etc.).

In use, as disclosed earlier, the packaging apparatus 200 is adapted to be positioned onto an output line of a foldable blank stack denester carrying the foldable blanks 280 for forming generally carton shaped secondary packages 250. The packaging apparatus 200 receives a continuous supply of the foldable blanks 290 which are first defined with a loading space 288 and then loaded with one or more articles, and then erected around the already loaded articles 290, and then formed into the corresponding secondary packages 250 by action of the vertical lugs 242 of the erecting mechanism 240, which are configured to push the closing flaps 287 of the erected foldable blanks 290 in a predetermined manner so as to close the one or more side flaps 287 of the foldable blank 280 using the one or more engaging mechanism and thereby forming the secondary package 250 already loaded with articles 290 in a desired configuration, manner or group.

INDUSTRIAL APPLICABILITY

Particularly advantageously, the packaging apparatus 200 is adapted to receive a supply of foldable blanks 280, which are first defined with a loading space 288, loaded with one or more articles in any desired manner and then erected there around such that no redundant tasks of first forming the package and then loading it with articles 290 is required.

Further, the packaging apparatus is adaptable to different dimensions of foldable blanks and is therefore well suitable to process the packages of different sizes with ease and efficiently.

Additionally, the packaging apparatus 200 of the present invention, while being applicable onto the conveyor system, does not impact the rest of the conveying process. A single conveyor system may utilize as many packaging apparatuses within the same arrangement. Further, in case of one packaging apparatus is not working, the others can keep working and therefore, the fault tolerance of the plant can be increased.

It is contemplated for a person skilled in the art that the secondary package 250 suitable for use within the context of the present invention may be implemented in various industries such as food industry, transport industry, house hold appliance industry in transportation of any kind of product or group of products, of any shape, size or any variety of configurations.

Moreover, while the packaging apparatus 200 of present invention has been disclosed in reference to the secondary package 250 formed of foldable blanks, it may be used to shape all currently known packages, known in the art including various packages formed from foldable blanks as well as packages constructed of materials such as thermoplastic, hybrid materials, woven metallic fabric that may include ferrous or nonferrous metals, etc., or any other suitable material.

The invention claimed is:

1. A packaging apparatus for in-line packaging wrapping of a foldable blank around a receiving load that is simultaneously dropped onto a loading space of the foldable blank, the apparatus comprising:

a support adapted to receive a supply of one or more foldable blanks, the support comprising a support frame supported onto two or more parallel longitudinal rails positioned generally transversal to a direction of supply of foldable blanks;

an article loading mechanism to load a group of articles onto the loading space defined onto the foldable blank received onto the support;

an erecting mechanism comprising a plurality of generally spaced apart generally vertically operating lugs, positioned onto one or more sides of the support frame, and at a height lower than the longitudinal rails, wherein said vertical lugs are adapted to perform a generally vertically upward movement engaging and erecting at least one side of the foldable blank around the articles already loaded onto the foldable blank, wherein the support frame comprises a foldable or collapsible deck supported horizontal for receiving the foldable blank; wherein the foldable or collapsible deck comprises a plurality of parallel elongated segments moveably configured transversal to the direction of supply of foldable blanks; the foldable or collapsible deck is configured to form a flush, flat, load bearing, support surface, wherein the support frame is foldable or collapsible upon moving the longitudinal rails towards each other.

2. The apparatus of claim 1, wherein the width of the support frame is adapted, in accordance with varying dimensions of the foldable blank, by moving the longitudinal rails towards and/or away from each other.

3. The apparatus of claim 1, wherein the foldable or collapsible deck comprises one or more foldable lattice support linkages or a foldable origami-like, or Miura fold-based support structure.

4. The apparatus of claim 1 wherein the support frame comprises suction devices for attaching the foldable blank.

5. The apparatus of claim 1, wherein the support and/or the erecting mechanism are wirelessly powered and wirelessly controlled.

6. The apparatus of claim 1, wherein the support is movingly positioned onto a closed loop linear track through one or more independently motion controlled movers movingly configured onto the each of the longitudinal rails.

7. The apparatus of claim 1, further comprising an locating mechanism for positioning the foldable blank onto the support.

8. Use of the apparatus of claim 1 in a packaging plant for packaging beverage containers.

9. A method for in-line packaging wrapping of a foldable blank around a receiving load that is simultaneously dropped onto a loading space of the foldable blank, comprising steps of supplying of one or more foldable blanks onto a support comprising a support frame supported onto two or more parallel longitudinal rails positioned generally transversal to a direction of supply of foldable blanks;

loading a group of articles onto the loading space defined onto the foldable blank received onto the support;

erecting at least one side of the foldable blank around the articles already loaded onto the foldable blank by way of an erecting mechanism comprising a plurality of generally spaced apart vertical lugs, positioned onto one or more sides of the support frame, and at a height lower than the longitudinal rails, wherein the support frame comprises a foldable or collapsible deck supported horizontal for receiving the foldable blank; wherein the foldable or collapsible deck comprises a plurality of parallel elongated segments moveably configured transversal to the direction of supply of foldable blanks; the foldable or collapsible deck is configured to form a flush, flat, load bearing, support surface, wherein the support frame is foldable or collapsible upon moving the longitudinal rails towards each other.

10. The method of claim 9, wherein the width of the support frame is adapted, in accordance with varying dimensions of the foldable blank, by moving the longitudinal rails towards and/or away from each other.

* * * * *